US008824637B2

(12) United States Patent
Morton

(10) Patent No.: US 8,824,637 B2
(45) Date of Patent: Sep. 2, 2014

(54) X-RAY TUBES

(75) Inventor: Edward James Morton, Guildford (GB)

(73) Assignee: Rapiscan Systems, Inc., Torrance, CA (US)

( * ) Notice: Subject to any disclaimer, the term of this patent is extended or adjusted under 35 U.S.C. 154(b) by 570 days.

(21) Appl. No.: 13/063,467

(22) PCT Filed: Sep. 11, 2009

(86) PCT No.: PCT/GB2009/051178

§ 371 (c)(1),
(2), (4) Date: May 25, 2011

(87) PCT Pub. No.: WO2010/029370

PCT Pub. Date: Mar. 18, 2010

(65) Prior Publication Data

US 2011/0222665 A1 Sep. 15, 2011

(30) Foreign Application Priority Data

Sep. 13, 2008 (GB) ..... 0816823.9

(51) Int. Cl.
*H01J 35/10* (2006.01)
*H01J 35/16* (2006.01)
*H01J 35/12* (2006.01)

(52) U.S. Cl.
CPC ..... *H01J 35/16* (2013.01); *H01J 35/165* (2013.01); *H01J 35/12* (2013.01)
USPC ..... 378/141; 378/130

(58) Field of Classification Search
CPC ... H01J 2235/1204; H01J 35/16; H01J 35/18; H01J 35/106; H01J 2235/1216
USPC ..... 378/130, 141, 199, 200
See application file for complete search history.

(56) References Cited

U.S. PATENT DOCUMENTS

| | | | |
|---|---|---|---|
| 2,101,143 | A | 12/1937 | Laidig |
| 2,952,790 | A | 9/1960 | Steen |
| 3,138,729 | A | 6/1964 | Henke |
| 3,239,706 | A | 3/1966 | Farrell |
| 3,768,645 | A | 10/1973 | Conway |
| 4,045,672 | A | 8/1977 | Watanabe |
| 4,057,725 | A | 11/1977 | Wagner |
| 4,105,922 | A | 8/1978 | Lambert |

(Continued)

FOREIGN PATENT DOCUMENTS

| | | | |
|---|---|---|---|
| CN | 1138743 | A | 12/1996 |
| CN | 1172952 | A | 2/1998 |

(Continued)

OTHER PUBLICATIONS

PCT/GB2004/001732, Feb. 25, 2005, WIPO Search Report.

(Continued)

*Primary Examiner* — Hoon Song
(74) *Attorney, Agent, or Firm* — Novel IP

(57) ABSTRACT

An X-ray tube is produced by forming a first housing section 20 from sheet metal; forming a second housing section 22 from sheet metal, mounting an electron source 18 in one of the housing sections; mounting an anode 16 in one of the housing sections; and joining the housing sections 20, 22 together to form a housing defining a chamber with the electron source 18 and the anode 16 therein.

11 Claims, 5 Drawing Sheets

(56) References Cited

U.S. PATENT DOCUMENTS

| | | | |
|---|---|---|---|
| 4,171,254 | A | 10/1979 | Koenecke |
| 4,228,353 | A | 10/1980 | Johnson |
| 4,241,404 | A | 12/1980 | Lux |
| 4,259,721 | A | 3/1981 | Kuznia |
| 4,266,425 | A | 5/1981 | Allport |
| 4,274,005 | A | 6/1981 | Yamamura |
| 4,340,816 | A | 7/1982 | Schott |
| 4,344,011 | A | 8/1982 | Hayashi |
| 4,352,021 | A | 9/1982 | Boyd |
| 4,420,382 | A | 12/1983 | Riedl |
| 4,468,802 | A | 8/1984 | Friedel |
| 4,531,226 | A | 7/1985 | Peschmann |
| 4,625,324 | A | 11/1986 | Blaskis |
| 4,672,649 | A | 6/1987 | Rutt |
| 4,675,890 | A | 6/1987 | Plessis |
| 4,677,651 | A | 6/1987 | Hartl |
| 4,719,645 | A | 1/1988 | Yamabe |
| 4,763,345 | A | 8/1988 | Barbaric |
| RE32,961 | E | 6/1989 | Wagner |
| 4,866,745 | A | 9/1989 | Akai |
| 4,868,856 | A | 9/1989 | Frith |
| 4,887,604 | A | 12/1989 | Shefer |
| 4,894,775 | A | 1/1990 | Kritchman |
| 5,033,106 | A | 7/1991 | Kita |
| 5,068,882 | A | 11/1991 | Eberhard |
| 5,073,910 | A | 12/1991 | Eberhard |
| 5,091,927 | A | 2/1992 | Golitzer |
| 5,159,234 | A | 10/1992 | Wegmann |
| 5,191,600 | A | 3/1993 | Vincent |
| 5,195,112 | A | 3/1993 | Vincent |
| 5,247,556 | A | 9/1993 | Eckert |
| 5,259,014 | A | 11/1993 | Brettschneider |
| 5,268,955 | A | 12/1993 | Burke |
| 5,272,627 | A | 12/1993 | Maschhoff |
| 5,305,363 | A | 4/1994 | Burke |
| 5,313,511 | A | 5/1994 | Annis |
| 5,329,180 | A | 7/1994 | Popli |
| 5,367,552 | A | 11/1994 | Peschmann |
| 5,375,156 | A | 12/1994 | Kuo-Petravic |
| 5,414,622 | A | 5/1995 | Walters |
| 5,467,377 | A | 11/1995 | Dawson |
| 5,511,104 | A | 4/1996 | Mueller |
| 5,515,414 | A | 5/1996 | dAchardVanEnschut |
| 5,541,975 | A | 7/1996 | Anderson |
| 5,568,829 | A | 10/1996 | Crawford |
| 5,596,621 | A | 1/1997 | Schwarz |
| 5,604,778 | A | 2/1997 | Polacin |
| 5,633,907 | A | 5/1997 | Gravelle |
| 5,654,995 | A | 8/1997 | Flohr |
| 5,680,432 | A | 10/1997 | Voss |
| 5,689,541 | A | 11/1997 | Schardt |
| 5,712,889 | A | 1/1998 | Lanzara |
| 5,798,972 | A | 8/1998 | Lao |
| 5,841,831 | A | 11/1998 | Hell |
| 5,859,891 | A | 1/1999 | Hibbard |
| 5,879,807 | A | 3/1999 | Inoue |
| 5,889,833 | A | 3/1999 | Silver |
| 5,907,593 | A | 5/1999 | Hsieh |
| 5,966,422 | A | 10/1999 | Dafni |
| 5,974,111 | A | 10/1999 | Krug |
| 5,987,097 | A | 11/1999 | Salasoo |
| 6,014,419 | A | 1/2000 | Hu |
| 6,018,562 | A | 1/2000 | Willson |
| 6,075,836 | A | 6/2000 | Ning |
| 6,108,575 | A | 8/2000 | Besson |
| 6,122,343 | A | 9/2000 | Pidcock |
| 6,130,502 | A | 10/2000 | Kobayashi |
| 6,181,765 | B1 | 1/2001 | Sribar |
| 6,183,139 | B1 | 2/2001 | Solomon |
| 6,188,747 | B1 | 2/2001 | Geus |
| 6,218,943 | B1 | 4/2001 | Ellenbogen |
| 6,229,870 | B1 | 5/2001 | Morgan |
| 6,236,709 | B1 | 5/2001 | Perry |
| 6,240,157 | B1 | 5/2001 | Danielsson |
| 6,269,142 | B1 | 7/2001 | Smith |
| 6,298,110 | B1 | 10/2001 | Ning |
| 6,324,243 | B1 | 11/2001 | Edic |
| 6,324,249 | B1 | 11/2001 | Fazzio |
| 6,341,154 | B1 | 1/2002 | Besson |
| 6,404,230 | B1 | 6/2002 | Cairns |
| 6,449,331 | B1 | 9/2002 | Nutt |
| 6,470,065 | B1 | 10/2002 | Lauther |
| 6,507,025 | B1 | 1/2003 | Verbinski |
| 6,553,096 | B1 | 4/2003 | Zhou |
| 6,580,780 | B1 * | 6/2003 | Miller ..... 378/141 |
| 6,624,425 | B2 | 9/2003 | Nisius |
| 6,674,838 | B1 | 1/2004 | Barrett |
| 6,721,387 | B1 | 4/2004 | Naidu |
| 6,754,298 | B2 | 6/2004 | Fessler |
| 6,785,359 | B2 | 8/2004 | Lemaitre |
| 6,975,703 | B2 | 12/2005 | Katcha |
| 6,993,115 | B2 | 1/2006 | Georgeson |
| 7,079,624 | B1 | 7/2006 | Miller |
| 7,192,031 | B2 | 3/2007 | Ying |
| 7,197,116 | B2 | 3/2007 | Dunham |
| 7,203,269 | B2 | 4/2007 | Huber |
| 7,218,700 | B2 | 5/2007 | Muenchau |
| 7,233,644 | B1 | 6/2007 | Bendahan |
| 7,664,230 | B2 | 2/2010 | Morton |
| 7,728,397 | B2 | 6/2010 | Gorrell |
| 2001/0022346 | A1 | 9/2001 | Katagami et al. |
| 2001/0033635 | A1 | 10/2001 | Kuwabara |
| 2002/0031202 | A1 | 3/2002 | Callerame |
| 2002/0082492 | A1 | 6/2002 | Grzeszczuk |
| 2002/0094064 | A1 | 7/2002 | Zhou |
| 2002/0097836 | A1 | 7/2002 | Grodzins |
| 2002/0140336 | A1 | 10/2002 | Stoner |
| 2002/0176532 | A1 | 11/2002 | McClelland |
| 2003/0021377 | A1 | 1/2003 | Turner |
| 2003/0043957 | A1 | 3/2003 | Pelc |
| 2003/0048868 | A1 | 3/2003 | Bailey |
| 2003/0076921 | A1 | 4/2003 | Mihara |
| 2003/0076924 | A1 | 4/2003 | Mario |
| 2003/0091148 | A1 | 5/2003 | Bittner |
| 2004/0017888 | A1 | 1/2004 | Seppi |
| 2004/0022292 | A1 | 2/2004 | Morton |
| 2004/0057554 | A1 | 3/2004 | Bjorkholm |
| 2004/0066879 | A1 | 4/2004 | Machida |
| 2004/0094064 | A1 | 5/2004 | Taguchi |
| 2004/0120454 | A1 | 6/2004 | Ellenbogen |
| 2004/0202282 | A1 | 10/2004 | Miller |
| 2004/0213379 | A1 | 10/2004 | Bittl |
| 2004/0258305 | A1 | 12/2004 | Skatter |
| 2005/0002492 | A1 | 1/2005 | Rother |
| 2005/0031075 | A1 | 2/2005 | Hopkins |
| 2005/0053189 | A1 | 3/2005 | Gohno |
| 2005/0100135 | A1 | 5/2005 | Lowman |
| 2005/0111610 | A1 | 5/2005 | Heumann |
| 2005/0123092 | A1 | 6/2005 | Mistretta |
| 2005/0175151 | A1 | 8/2005 | Dunham |
| 2005/0276377 | A1 | 12/2005 | Carol |
| 2005/0276382 | A1 | 12/2005 | Lesiak |
| 2006/0050842 | A1 | 3/2006 | Wang |
| 2007/0064873 | A1 | 3/2007 | Gabioud |
| 2007/0183575 | A1 | 8/2007 | Lemaitre |
| 2007/0297570 | A1 * | 12/2007 | Kerpershoek et al. ..... 378/130 |
| 2008/0019483 | A1 | 1/2008 | Andrews |
| 2008/0056436 | A1 | 3/2008 | Pack |
| 2008/0123803 | A1 | 5/2008 | DeMan |
| 2008/0130974 | A1 | 6/2008 | Xu |
| 2009/0022264 | A1 | 1/2009 | Zhou |
| 2009/0159451 | A1 | 6/2009 | Tomantschger |
| 2009/0185660 | A1 | 7/2009 | Zou |
| 2010/0111265 | A1 * | 5/2010 | Holm et al. ..... 378/200 |
| 2011/0188725 | A1 | 8/2011 | Yu |

FOREIGN PATENT DOCUMENTS

| | | | |
|---|---|---|---|
| DE | 2729353 | A1 | 1/1979 |
| DE | 3840398 | A1 | 6/1989 |
| DE | 4432205 | C1 | 1/1996 |
| DE | 4425691 | A1 | 2/1996 |
| DE | 19745998 | A1 | 3/1999 |
| DE | 10036210 | A1 | 11/2001 |

(56) References Cited

FOREIGN PATENT DOCUMENTS

| | | | |
|---|---|---|---|
| DE | 10319549 | B3 | 12/2004 |
| EP | 0142249 | A2 | 5/1985 |
| EP | 0432568 | | 6/1991 |
| EP | 0531993 | A1 | 3/1993 |
| EP | 0584871 | A1 | 3/1994 |
| EP | 0924742 | A2 | 6/1999 |
| EP | 0930046 | A2 | 7/1999 |
| EP | 1277439 | A1 | 1/2003 |
| EP | 1374776 | A1 | 1/2004 |
| EP | 1558142 | A1 | 8/2005 |
| FR | 2328280 | A1 | 5/1977 |
| FR | 2675629 | A1 | 10/1992 |
| GB | 1149796 | A | 4/1969 |
| GB | 1272498 | A | 4/1972 |
| GB | 1497396 | A | 1/1978 |
| GB | 1526041 | A | 9/1978 |
| GB | 2015245 | A | 9/1979 |
| GB | 2089109 | A | 6/1982 |
| GB | 2212903 | A | 8/1989 |
| GB | 2212975 | A | 8/1989 |
| GB | 2360405 | A | 9/2001 |
| JP | S5975549 | | 4/1974 |
| JP | 50081080 | A | 7/1975 |
| JP | S51055286 | | 5/1976 |
| JP | S51078696 | | 7/1976 |
| JP | S52050186 | | 4/1977 |
| JP | S5493993 | | 7/1979 |
| JP | S55046408 | | 4/1980 |
| JP | S5717524 | A | 1/1982 |
| JP | 570175247 | | 10/1982 |
| JP | S57175247 | A | 10/1982 |
| JP | 58212045 | A | 12/1983 |
| JP | 590016254 | | 1/1984 |
| JP | 590016254 | A | 1/1984 |
| JP | S591625 | A | 1/1984 |
| JP | S5916254 | A | 1/1984 |
| JP | 59075549 | | 4/1984 |
| JP | S5975549 | A | 4/1984 |
| JP | 600015546 | | 1/1985 |
| JP | S601554 | A | 1/1985 |
| JP | S602144 | | 1/1985 |
| JP | 600021440 | | 2/1985 |
| JP | S6038957 | A | 2/1985 |
| JP | 62044940 | A | 2/1987 |
| JP | 63016535 | | 1/1988 |
| JP | 1296544 | A | 11/1989 |
| JP | 03198975 | | 8/1991 |
| JP | H03198975 | A | 8/1991 |
| JP | H0479128 | A | 3/1992 |
| JP | H04319237 | | 11/1992 |
| JP | 05135721 | | 6/1993 |
| JP | H05135721 | A | 6/1993 |
| JP | 05182617 | | 7/1993 |
| JP | H05182617 | A | 7/1993 |
| JP | 05290768 | | 11/1993 |
| JP | H05290768 | A | 11/1993 |
| JP | 060038957 | | 2/1994 |
| JP | H0638957 | A | 2/1994 |
| JP | H06261895 | | 9/1994 |
| JP | H07093525 | | 4/1995 |
| JP | H09171788 | | 6/1997 |
| JP | H10211196 | A | 8/1998 |
| JP | H10272128 | | 10/1998 |
| JP | H11500229 | | 1/1999 |
| JP | 2000175895 | | 6/2000 |
| JP | 2001176408 | A | 6/2001 |
| JP | 2001204723 | | 7/2001 |
| JP | 2002343291 | | 11/2002 |
| JP | 2003092076 | | 3/2003 |
| JP | 2003121392 | | 4/2003 |
| JP | 2003126075 | A | 5/2003 |
| JP | 2004000605 | A | 1/2004 |
| JP | 2004079128 | A | 3/2004 |
| JP | 2004311245 | | 11/2004 |
| JP | 2005013768 | A | 1/2005 |
| JP | 2006351272 | A | 12/2006 |
| JP | 2008166059 | A | 7/2008 |
| JP | 100211196 | | 9/2010 |
| SU | 1022236 | A1 | 6/1983 |
| WO | 9528715 | A2 | 10/1995 |
| WO | 9718462 | A1 | 5/1997 |
| WO | 9960387 | A2 | 11/1999 |
| WO | 0231857 | | 4/2002 |
| WO | 03051201 | A2 | 6/2003 |
| WO | 2004042769 | A1 | 5/2004 |
| WO | 2004097386 | A1 | 11/2004 |
| WO | 2004097888 | A2 | 11/2004 |
| WO | 2004097889 | A2 | 11/2004 |
| WO | 2006130630 | A2 | 12/2006 |
| WO | 2009012453 | A1 | 1/2009 |
| WO | 2010086653 | | 8/2010 |

OTHER PUBLICATIONS

PCT Search Report, Morton, Edward James et al Search Report PCT/GB2004/001729.

STMicroelectronics, "Dual Full-Bridge Driver", Datasheet for L298, 2000, pp. 1-13, XP002593095.

Great Britain Patent Application No. GB0816823.9 Search Report Oct. 20, 2009.

Great Britain Patent Application No. GB1104148.0 Examination Report Mar. 29, 2011.

Chinese Patent Application No. 200980114807.X Second Office Action Nov. 21, 2013.

Bruder et al. "Efficient Extended Field of View (eFOV) Reconstructuion Techniques for Multi-Slice Helical CT" Medical Imaging 2008: Physics of Medical Imaging, edited by Jiang Hsieh, Ehsan Samei, Proc. of SPIE VOI. 6913, 69132E, (2008).

Search Report for PCT/US10/41871, Jan. 20, 2011, Rapiscan Systems, Inc.

PCT Search Report, dated Mar. 3, 2005, Morton, Edward James et al. Search Report PCT/GB2004/001741.

PCT Search Report, dated May 27, 2005, Morton, Edward James et al. Search Report PCT/GB2004/001731.

PCT Search Report, dated Mar. 21, 2005, Morton, Edward James et al. Search Report PCT/GB2004/001751.

PCT Search Report, Morton, Edward James et al. Search Report PCT/GB2004/001747.

Search Report PCT/GB2009/001760, Jan. 21, 2010, Morton et al.

PCT Search Report PCT/US10/37167, Dec. 9, 2010, Rapiscan Security Products, Inc.

US 5,987,079, 11/1999, Scott (withdrawn)

* cited by examiner

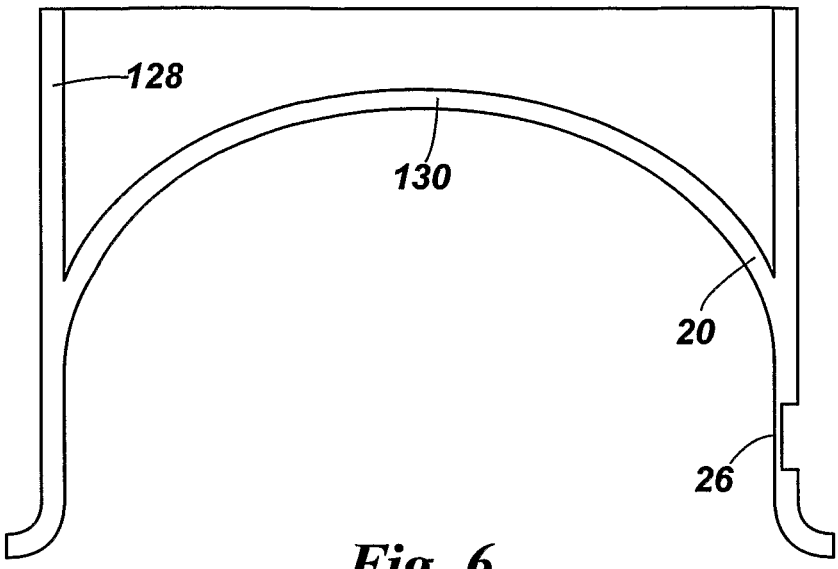
Fig. 6
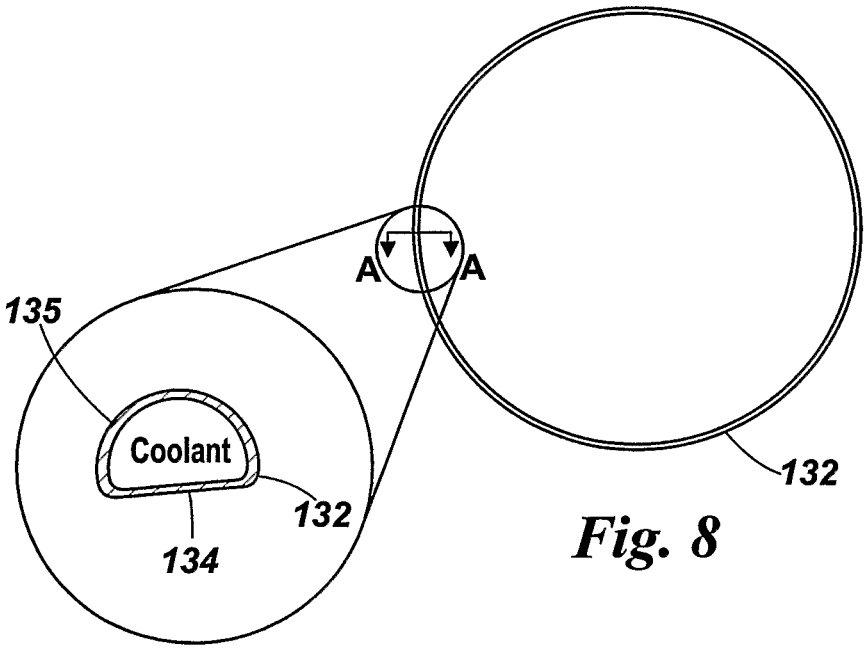
Fig. 8
Fig. 8a

X-RAY TUBES

CROSS-REFERENCE TO RELATED APPLICATIONS

The present application is a national stage application of PCT/GB2009/051178, filed on Sep. 13, 2008. The present application further relies on Great Britain Patent Application Number 0816823.9, filed on Sep. 11, 2009, for priority. Both priority applications are herein incorporated by reference in their entirety.

FIELD OF THE INVENTION

The present invention relates to X-ray tubes and in particular to multi-focus X-rays tubes for imaging applications.

BACKGROUND OF THE INVENTION

Multi-focus X-ray tubes generally comprise a single anode in linear or arcuate geometry which can be irradiated along its length by two or more switched electron sources. In a typically configuration, hundreds of electron sources or guns might be used to irradiate a single anode with a length of over 1 m. Often the electron guns will be actuated individually and sequentially in order to create a rapidly moving X-ray beam. Alternatively, the electron sources can be actuated in groups to provide X-rays beams with varying spatial frequency composition.

Known multi-focus X-ray sources tend to use combination metal and ceramic housings fabricated using standard vacuum seals such as con-flat assemblies or metal gasket seals. Such assemblies are extremely expensive to put together since they require precision machining to meet stringent vacuum requirements.

SUMMARY OF THE INVENTION

The present invention therefore provides a method of producing an X-ray tube comprising forming a first housing section from sheet metal; forming a second housing section from sheet metal, mounting an electron source in one of the housing sections; mounting an anode in one of the housing sections; and joining the housing sections together to form a housing defining a chamber with the electron source and the anode therein.

The housing sections may be formed by pressing. This makes the method quick and efficient. Various features of the housing, such as welding formations or mounting apertures for feed-throughs, may be formed by stamping. This can be done simultaneously and on the same press tool as the formation of the main housing sections, or may be done as a separate step.

The present invention further provides an X-ray tube comprising housing, an anode supported in the housing, and an X-ray source arranged to generate beams of electrons directed at a plurality of positions on the anode, wherein the housing comprises two sections formed from sheet metal.

The present invention further provides a method of producing an anode for an X-ray tube, the method comprising providing a tubular member and forming the tubular member so as to form a target surface thereon.

The present invention further provides an X-ray tube comprising an anode; an electron source arranged to generate a beam of electrons, wherein the anode comprises a tubular member having a target surface thereon at which the beam of electrons can be directed; and a coolant supply arranged to deliver coolant to flow through the tubular member to cool the anode.

The present invention further provides an X-ray tube comprising a housing; an anode within the housing, the anode including a cooling duct through which coolant can be passed to cool the anode; a coolant circuit through which coolant can be supplied to and returned from the anode; and a feed-through extending through the housing and comprising an electrical connection for connecting an electrical supply to the anode and a coolant passage arranged to form part of the coolant circuit.

BRIEF DESCRIPTION OF THE DRAWINGS

Preferred embodiments of the present invention will now be described by way of example only with reference to the accompanying drawings in which:

FIG. 6 is a cross section through an anode section of the housing of the tube of FIG. 1;

FIG. 8 is side view of an anode of the tube of FIG. 1; and

FIG. 8*a* is a cross section through the anode of FIG. 8.

DETAILED DESCRIPTION OF THE INVENTION

Figure 1:
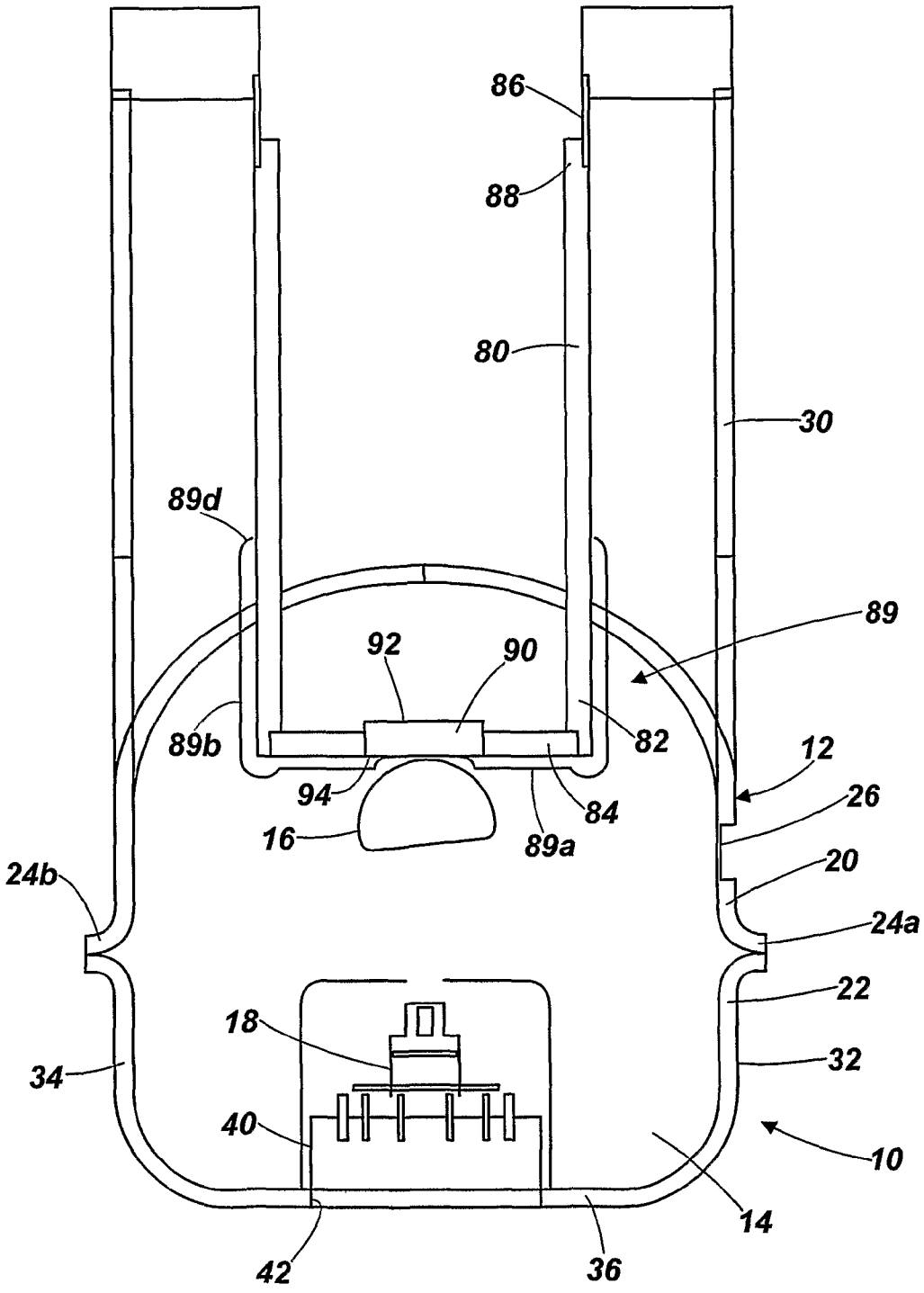
FIG. 1 is a cross section through a multi-focus X-ray tube according to an embodiment of the invention.

Referring to FIG. 1, an X-ray tube 10 comprises a housing 12 which defines a vacuum chamber 14, with a hollow tubular anode 16 and a series of electron sources or guns 18 supported inside the vacuum chamber 14. In this embodiment the vacuum chamber is in the shape of a torus arranged to extend around a scanning volume, but other shapes can be used as appropriate for different applications.

The housing 12 is formed in two sections: an anode section 20 and a cathode section 22. The anode section 20 is approximately semi-circular or C-shaped in section with weld rims 24*a*, 24*b* formed at its radially inner and outer edges. The anode 16 is supported on the anode section 20 by means of an anode feed-through 30 which is formed separately from the housing 10 and welded onto it, as will be described in more detail below, and a number of mountings which are similar to the feed-through 30 but do not include the electrical connections of the feed-through, being for physical support only. An exit window 26 is formed in the radially inner side of the anode section 20, so as to allow beams of X-rays, generated at each of a large number of positions along the anode 16 by the electron guns 18, to exit the housing in the radially inward direction.

The cathode section 22 of the housing 12 is of a slightly more square section than the anode section 20, having radially inner and outer side walls 32, 34 and a flat back wall 36 on which the electron sources 18 are mounded. Each electron source 18 extends round an arc of the scanner, and is arranged to generate beams of electrons from each of a number of positions along its length in a controlled sequence, by the electrical switching of the voltage applied to respective control elements to control the extraction or suppression of electrons from respective positions along a cathode.

In this embodiment, both housing sections 20, 22 are formed from pressed metal sheets typically using a low carbon stainless steel such as 316L. The pressed parts are sculptured to provide additional strength allowing the material thickness to be reduced to 2 mm or below. The sculpturing design uses large radii (typically greater than 5 mm) to reduce internal electric field strengths within the tube.

The resulting housing parts 20, 22 are extremely rigid and light when compared to the machined equivalents. Further, the parts, being fully radiused, provide excellent support of the electrostatic fields within the tube which can allow the volume of the enclosed vacuum chamber 14 to be reduced substantially when compared to a machined tube equivalent. Further, the surface area of the exposed metal surfaces tends to be low compared to a machined equivalent so reducing the gas inventory which can outgas into the tube during operation. This prolongs tube lifetime and reduces cost of the associated ion pumping system.

In a typical application such as security screening or medical diagnostics, the overall weight of the X-ray system is often a critical factor and the intrinsically light weight of this tube design is important in meeting this key design objective.

As an alternative to stamping, a spinning process may be used to form the housing parts although in this case the wall thickness, and hence weight of the finished tube, will be greater than when the parts are stamped.

Figure 3:
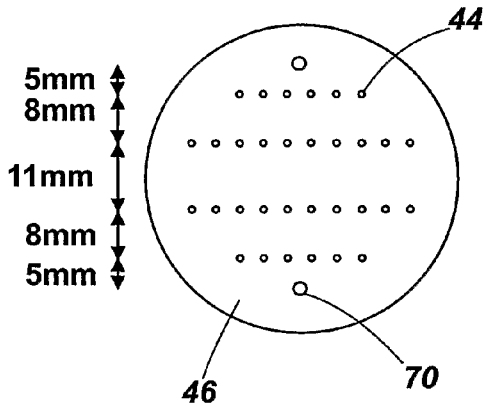
FIG. 3 is a front view of the feed-through of FIG. 2.
Figure 2:
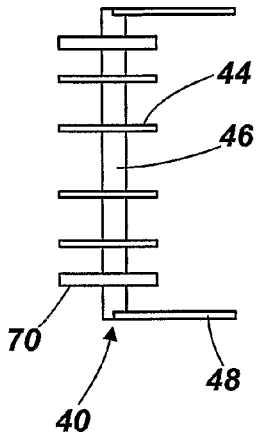
FIG. 2 is a section through a feed-through in a cathode section of the X-ray tube of FIG. 1.

It is necessary to add electrically insulated signal feed-throughs 40 through the cathode part 22 in order to provide switching potentials for the control elements in the electron guns 18. It is advantageous from a manufacturing yield perspective to pre-fabricate the feed-through parts and to then weld these into pre-cut holes 42 in the formed cathode section 22. Referring to FIGS. 2 and 3, in one embodiment the individual feed-throughs 44 are formed as metal pins brazed or glassed into respective holes through an alumina ceramic disk 46 which is itself brazed or glassed to a metal ring 48 which fits into the round hole 42 and is then welded to the cathode section 22. The outer ends 50 of the pins project on the outside of the disk 46 for connection to external control lines, and the inner ends 52 of the pins project into the vacuum chamber 14. As can be seen in FIG. 3, the pins 44 are arranged in four rows. In this embodiment the pins 44 and the ring 48 are made of Nilo-K, but other suitable materials can be used.

Figure 4:
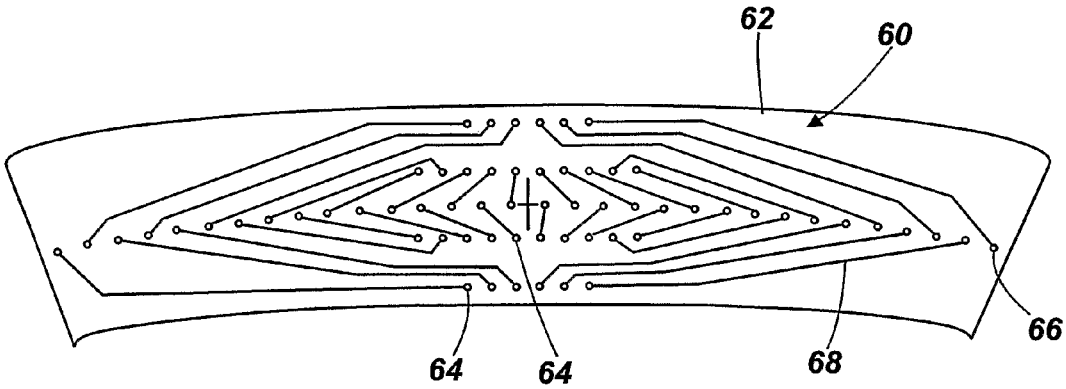
FIG. 4 is a front view of a connection board in the cathode section of the X-ray tube of FIG. 1.

Referring to FIG. 4, a connection board 60 comprises an insulating support layer 62 with a first set of connections 64 arranged in four rows with corresponding spacing to the feed-through pins 44, and a second set of connections 66 arranged in a single line extending along the cathode of the electron source 18. Each of the connections of the first set is connected by a respective conducting track 68 to a respective one of the second set, so that the control elements spaced along the electron source can be controlled by from the external contacts to the feed through pins 44.

Referring back to FIGS. 3 and 4, two further larger diameter metal feed-through pins 70 are also provided in the ceramic disk 46 of metal-ceramic feed-through assembly. These pins 70 are used to provide electrical power to the electron gun heater assemblies. Typically, the heaters will run at low voltage (e.g. 6.15V) but at high current (e.g. 3.8 A per 32 emitter module). Advantageously these pins 70 can be made from Mo which can be glazed directly into the alumina ceramic end cap disk 46.

As an alternative individually insulated feed-throughs may be brazed or glazed into a metal disk which can then be welded into the tube housing assembly.

In a first approach to the manufacture of the tube, the same press tool that is used to form the cathode section 22 can be provided with cutting shapes that stamp out the holes 42 for the feed-through components 40. This press tool can also be provided with indenting features that stamp out a weld preparation in the cathode section, arranged to be welded to the ring 48 of the feed-through assembly 40, simultaneously with cutting and stamping. This is a very cost effective and accurate process which requires minimal operator involvement.

In a second approach, the stamped cathode section 22 can be laser-cut to introduce the holes 42 into which the cathode feed-throughs will be welded. A lower power laser beam can then be used to cut out channels around the feed-through holes 42 in order to form a weld preparation. This is a more expensive operation but provides greater flexibility to the operator.

Of course, it is also possible to use standard machine tools to cut out the cathode feed-through apertures 42 and to introduce the necessary weld preparations. This tends to be a more expensive approach since it requires greater setup time and more extensive clamping of the cathode section 22 during machining with consequently greater operator time requirement.

Referring back to FIG. 1, the anode section 20 requires a high voltage standoff which is provided by the feed-through 30 through which the anode high voltage can be connected. The feed-through 30 comprises a ceramic tube 80 which is glazed at its inner end 82 to a ceramic end cap 84 and to a Nilo-K metal ring 86 at its outer end 88. This assembly provides the necessary HV standoff.

To assist in supporting the required HV, the ceramic tube 80 is glazed with a conductive film leaving around 10 GOhm resistance between the two ends of the part. This forces a current of around 1 uA to pass down the ceramic during high voltage operation so controlling the potential gradient across the ceramic while also providing a current path to ground for any electrons that might scatter from the anode inside the tube and reach the surface of the ceramic. This provides stability against high voltage flashover and minimizes the overall length of the standoff ceramic. Once the conductive glaze has been applied, a thin Pt metal ring is painted around the top and bottom of the feed-through and fired in air in order to provide a contact for connection of the resistive films to HV and ground.

A further conductive ceramic resistor cap 90 with good dielectric strength but reasonably high electrical conductivity (10 kOhm-100 kOhm resistance typical) is glazed into the ceramic end cap 84. Advantageously, a field-shaping electrode 89 is provided which covers the vacuum-side of the ceramic end cap 84 and the join between the end cap 84 and the ceramic tube 80 and is electrically connected to the ceramic resistor cap 90. The electrode 89 has an annular part and a tubular part extending from the radially-outer edge of the annular part. The annular part connects to the ceramic resistor cap 90 at a point on its vacuum-side face midway between the centre and the radially outer edge, and the tubular part extends alongside, but spaced from, a part of the ceramic tube 80 so as to surround the part of the ceramic tube 8. The distal end of the tubular part carries a lip 89*a* which curves inwardly towards, but not into contact with, the ceramic tube 80. No part of the electrode 89 is in contact with either the ceramic end cap 84 or the ceramic tube 80, and it will be appreciated from FIG. 1 that where the end cap 84 joins the ceramic tube 80 the separation distance between the electrode and the end cap is increased. The electrode 89 is held at anode potential by virtue of its electrical connection to the ceramic resistor cap 90, and so it has the advantage of improving tube stability by intercepting stray electrons (from the anode or cathode) so as to substantially prevent them from reaching the ceramic tube 80 which is thereby prevented from charging. The electrode 89 can be formed of conductive metal or conductive ceramic. Those skilled in the art will appreciate alternative shapes of electrode suitable for the same or similar purposes i.e. to protect the ceramic tube 80, or at least a part thereof, from stray electrons from at least one of the anode and the cathode. It is possible, for example, to achieve a similar effect by extending the painted Pt metal ring so as to cover the join between the ceramic tube 80 and the ceramic end cap 84, and so as to extend part way along the outside of the ceramic tube 80.

The ceramic resistor cap 90 is metalized (with Pt) on its two outer surfaces 92, 94 to provide a current surge limiting resistor that takes effect in the event of a high voltage flashover occurring inside the tube itself. In this case, the full tube voltage appears over this resistor 90 which limits current flow and so controls the flashover. The value of the resistor 90 is chosen to be as large as possible to minimize current during a flashover, but as small as possible to minimize thermal power dissipation and voltage drop during normal tube operation. A sprung contact (not shown) connects the air side of this ceramic resistor 90 to the high voltage terminal 96 of the anode HV receptacle 98.

The HV receptacle 98 is of conventional HV design, and comprises a cylindrical body 100 supporting an HV plug 102, with a conducting metal bar 103 connecting the plug 102 to the high voltage terminal 96. However, the body 100 has a coolant channel 104 formed through it in the form of a bore extending from its outer end 106 to its inner end 109 to pass coolant back from the anode 16. The HV receptacle extends through the ceramic tube 80 but is of smaller diameter so that a space 108 is formed around the receptacle 98 inside the ceramic tube 80. This space 108 also extends between the inner end 109 of the receptacle 98 and the end cap 84 and forms a coolant volume. The inner end of the coolant channel 104 connects via a sprung washer 110 to the ceramic end cap 84. Two pipe stubs 112, 114 extend through holes in the end cap 84, each having one end connected to the hollow anode 16. Holes are cut through the anode 16 before the pipe stubs 112, 114 are connected to it, and the stub pipes are connected over the holes which form ports to provide fluid connection to the coolant passage within the anode 16. One of these pipe stubs 112 has its outer end covered by the sprung washer 110 to form a return passage from the anode 16 to the coolant channel 104, and the other 114 connects the anode 16 to the space 108 between the HV receptacle 98 and the ceramic tube 80.

At the outer end of the HV receptacle 98, the space 108 is closed by an end plate 116. The end plate 116 has a coolant inlet channel 118 formed in it which connects to the space 108 and a coolant outlet channel 120 which connects with the channel 104 through the HV receptacle 98. The HV end plate 116 of the HV receptacle is bolted at the ground referenced end to a support ring 124 in which the Nilo-K ring 86 is supported, and which therefore forms part of the anode HV metal ceramic feed-through, using an O-ring seal 122 to contain the coolant. This forms a coolant circuit through which coolant can be fed to and from the hollow anode 16. Coolant fed to the inlet channel 118 is passed into the space 108 between the anode HV metal ceramic feed-through and the anode receptacle 98 in order to cool the feed-through itself and to provide suitable HV passivation of the feed-through assembly. It also passes into the lower part of the coolant volume where it flows over the ceramic resistor 90 to cool it. From there it flows into the anode 16 through the stub pipe 114. Coolant returned from the anode 16 is forced to pass through the stub pipe 112, the spring washer 10 which separates the return path from the inlet coolant volume 108, and then through the coolant channel 104 and back out through the outlet channel 120 to the external cooling system.

Figure 5:
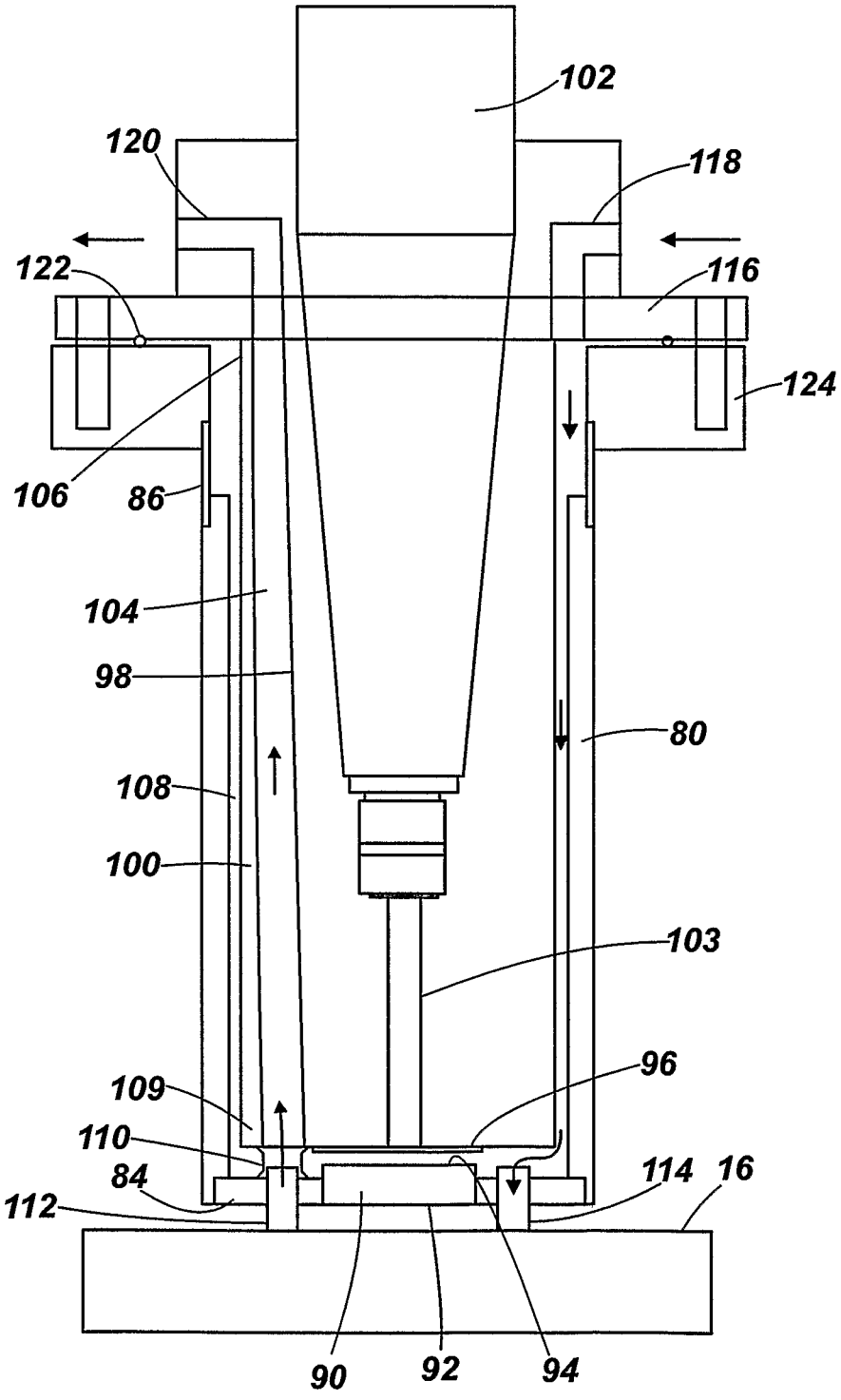
FIG. 5 is a section through a HV feed-through for the anode of the X-ray tube of FIG. 1.

In a modification to the design of FIG. 5, the conducting bar 103 can be replaced by a high resistance surge resistor, for example in the form of a ceramic plug, which performs the same function as the ceramic resistor 90. In this case the ceramic resistor 90 can be omitted and a low resistance connection provided between the surge resistor and the anode.

Figure 7:
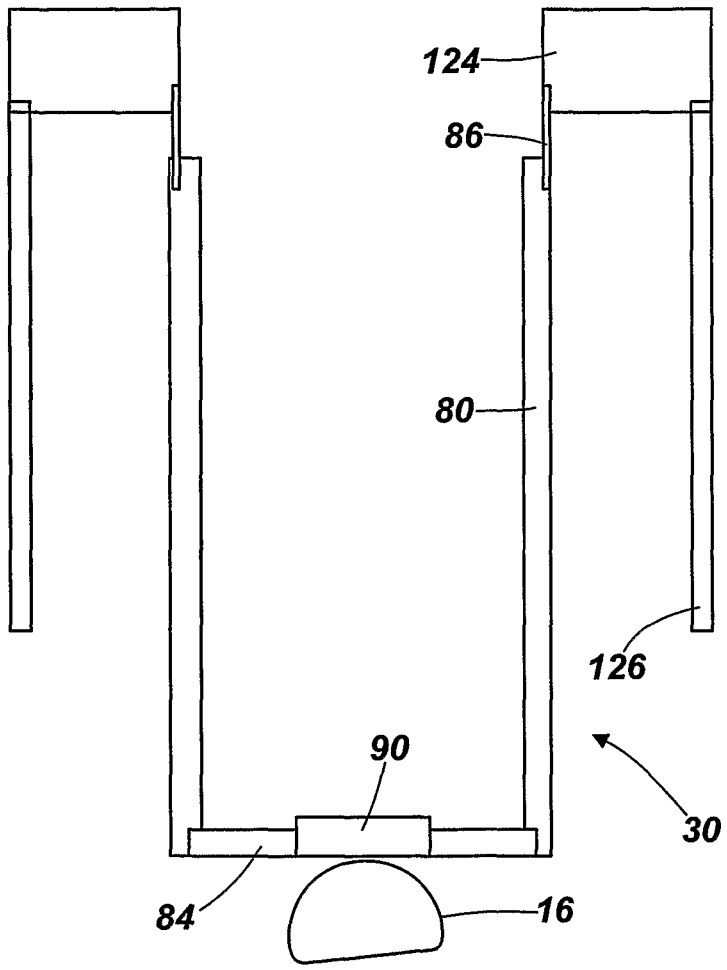
FIG. 7 is a cross section through a high voltage feed-through of the tube of FIG. 1.

Referring to FIGS. 6 and 7, the anode feed-through is supported in the anode housing section 12 by means of a support tube 126 extending from a support ring 124 around the ceramic tube 80. This support tube 126 is welded to a raised circular rim 128 formed on the outside of the anode section 12 of the housing. The raised rim 128 can be formed by the stamping tool that forms the anode section 12 so that it projects with smooth contours from the main anode section. The stamping tool can be further designed to cut through the top of the curved back portion 130 of the anode section 12 to provide a clean weld flange to which the ceramic tube 80 of the anode high voltage feed-through can be welded. This is a very low cost and quick manufacturing process.

Alternatively, the raised rim section 128 can be prepared prior to welding by using a laser cutter to cut off the top of the stamped rim section. This is a more expensive operation requiring additional operator involvement.

Once the anode feed-through has been welded to the raised anode rim section 128, it is advantageous to clean the interior of the anode tube section 20 to remove weld debris that might affect high voltage stability.

If thick metal sheet has been used to form the anode and cathode sections 20, 22, it is advantageous to form the thin window section 26 for the X-ray beam to emit through in that metal sheet. This is possible if the metal sheet is of stainless steel, as it is reasonable to use a stainless steel exit window in order to absorb low energy X-ray photons which otherwise will typically cause excess skin dose in medical applications and will cause beam hardening in security and CT applications.

To create the exit window 26, a suitable low cost technique is to use a rolling tool to shift metal out of the exit window area. Alternatively, a cutting or grinding machine tool can be used to thin the window area 26.

Various methods may be used to form the X-ray target on the hollow tubular anode 16. Referring to FIG. 8, in this embodiment, a metal tube 132 is shaped into a circular ring form. The metal tube 132 is then introduced into a forming element and deformed by hydro-forming, to shape it to an approximately semi-circular section. The formed anode therefore has a flat face 134 which forms the target, a curved rear side 135 and a hollow interior which forms a coolant passage through which coolant can flow to cool the anode.

Ideally, a hydro-forming process is used to develop the anode shape. This has the advantage of leaving the anode very rigid. Alternatively, a stamping process can be used to form the anode 16 to the required shape.

The anode 16 is ideally fabricated from a ductile metal such as copper or stainless steel. Copper has the advantage of excellent thermal conductivity but relatively poor mechanical strength and a tendency to creep under high temperature. Stainless steel is a very good vacuum material and forms easily but suffers from relatively poor thermal conductivity. Both copper and stainless steel have similar coefficients of thermal expansion and so minimise mechanical stress between the anode and tube housing 12 during high temperature bakeout.

To enhance X-ray yield, it is advantageous to coat the target area of the formed anode with a high-Z refractive material such as tungsten. A low cost process to deposit tungsten onto the anode 16 is thermal spray coating. This is a rapid process which can be used to deposit even thick layers of tungsten or tungsten carbide.

As an alternative, the anode can be formed from a high-Z and intrinsically refractive material such as molybdenum. This can allow one to dispense with the tungsten coating process while still achieving high X-ray yield, albeit at a slightly lower mean X-ray energy than when using tungsten.

Once the interior sections of the tube have been assembled (the electron gun assemblies 18 and the anode assembly 16), the tube may be sealed by welding the inner and outer flanges together that are produced when the anode and cathode sections are brought together. By providing a weld lip 24*a*, 24*b* as shown in FIG. 1, the amount of weld debris that enters the tube can be reduced to a very low level. It is advantageous to use clean TIG welding methods to complete tube assembly.

Due to the compact nature of the tube of this embodiment, it is possible to minimise weight of the complete system by wrapping the shielding material directly around the X-ray tube itself. For example, in this embodiment, cast lead parts are formed, one shaped to snugly fit around the cathode section 22 and one shaped to fit around the anode section 24. A typical lead thickness for use with X-ray tube voltages around 160 kV will be 12 mm or even less depending on anticipated tube operating current.

As a further aspect of this invention, it is recognised that multiple tube housing sections of different sizes can be stamped concentrically out of a single sheet of metal simultaneously. For example, anode or cathode sections destined for circular tubes suitable for motionless CT applications can be formed simultaneously for 30 cm, 60 cm, 90 cm and 120 cm inspection apertures from a single sheet of metal with around 2 m square profile.

The invention claimed is:

1. An X-ray tube comprising an anode; an electron source arranged to generate a beam of electrons, wherein the anode comprises a hollow interior and a tubular member having a target surface thereon at which the beam of electrons can be directed; a feed through adapted to connect the anode high voltage wherein said feed through comprises a ceramic tube having an inner end and an outer end, wherein the inner end is attached to a ceramic end cap and the outer end is attached to a metal ring, and wherein the ceramic tube is glazed with a conductive film configured to provide a 10 G ohm resistance between the inner end and outer end, and a coolant supply arranged to deliver coolant to flow through the hollow interior to cool the anode.

2. An X-ray tube according to claim 1 wherein the tubular member is formed into a ring to form a circular anode.

3. An X-ray tube according to claim 1 wherein the target surface is at least partially coated with a target material.

4. An X-ray tube comprising a housing; an anode within the housing, the anode comprising a hollow interior configured as a cooling duct through which coolant can be passed to cool the anode; a coolant circuit through which coolant can be supplied to and returned from the anode; a feed-through extending through the housing and comprising an electrical connection for connecting an electrical supply to the anode, wherein said feed through comprises a ceramic tube having an inner end and an outer end, wherein the inner end is attached to an end cap and wherein the outer end is attached to a metal ring, and wherein the ceramic tube is glazed with a conductive film configured to provide a 10 G ohm resistance between the inner end and outer end and to force a current of approximately 1 μA to pass through the ceramic tube during operation; and a coolant passage arranged to form part of the coolant circuit.

5. An X-ray tube according to claim 4 comprising a support body wherein the electrical connection includes an electrical connector supported in the support body.

6. An X-ray tube according to claim 5 wherein the support body has a bore through it forming part of the coolant circuit.

7. An X-ray tube according to claim 5 further comprising a tubular member extending around the support body and spaced therefrom so as partially to define a coolant volume, the coolant volume forming part of the coolant circuit.

8. An X-ray tube according to claim 7 wherein the end cap is configured to cover the end of the tubular member and is spaced from the support body so that the coolant volume extends around the end of the support body.

9. An X-ray tube according to claim 8 wherein the end cap includes a resistor forming part of the electrical connection, and coolant in the coolant volume is arranged to cool the resistor.

10. An X-ray tube according to claim 9, wherein the electrode is electrically connected to the resistor.

11. An X-ray tube according to claim 8 further comprising a connector extending across the coolant volume to form a fluid path connecting the anode to the bore through the support body.

* * * * *